United States Patent [19]

Fleming et al.

[11] Patent Number: 4,754,624

[45] Date of Patent: Jul. 5, 1988

[54] LOCK ASSEMBLY FOR SLIDING DOORS

[75] Inventors: Paul D. Fleming, Glendale; Nandor Gajer, Woodland Hills, both of Calif.

[73] Assignee: W&F Manufacturing, Glendale, Calif.

[21] Appl. No.: 6,454

[22] Filed: Jan. 23, 1987

[51] Int. Cl.[4] ..... E05B 65/08

[52] U.S. Cl. ..... 70/95; 70/99; 70/462; 292/39; 292/302

[58] Field of Search ..... 70/82, 95, 99, 100, 70/402; 292/39, 142, 302

[56] References Cited

U.S. PATENT DOCUMENTS

| | | | |
|---|---|---|---|
| 2,166,535 | 7/1939 | Sarenholm | 292/39 |
| 2,284,921 | 6/1942 | Purkiss | 292/302 |
| 2,787,154 | 4/1957 | Wesberry | 292/39 |
| 2,817,551 | 12/1957 | Gieleghem | 292/302 |
| 3,086,383 | 4/1963 | Scott | 292/39 |
| 3,308,579 | 3/1967 | Thams | 292/39 |
| 3,403,432 | 10/1968 | Bencene | 292/302 |
| 4,370,874 | 2/1983 | Munn | 70/462 |
| 4,631,937 | 12/1986 | Debus | 292/39 |
| 4,648,636 | 3/1987 | Reynard | 292/39 |

OTHER PUBLICATIONS

Advertising Fullex Ltd. United Kingdom (one page).
Advertising Fullex U.S., Inc. (two pages).

*Primary Examiner*—Robert L. Wolfe
*Attorney, Agent, or Firm*—Kelley, Bauersfeld & Lowry

[57] ABSTRACT

An improved lock assembly is provided for high security locking of sliding door particularly such as sliding glass patio doors used in residential dwellings and the like. The improved lock assembly comprises a lock mechanism incorporated into the vertical stile at one side of a sliding door, wherein the lock mechanism is adapted for respective keyed and keyless operation from opposite sides of the door for displacing dual latch members toward and away from each other between locked and unlocked positions. In the locked position, the dual latch members engage a latch keeper on the adjacent door jamb for positively locking the door against unauthorized entry. The lock mechanism is conveniently integrated into a compact cartridge for facilitated mounting into a hollow extruded metal stile. In addition, the lock mechanism may include internal tumblers designed to resist keyless unlocking from the outdoor side of the door.

20 Claims, 7 Drawing Sheets

FIG. 15
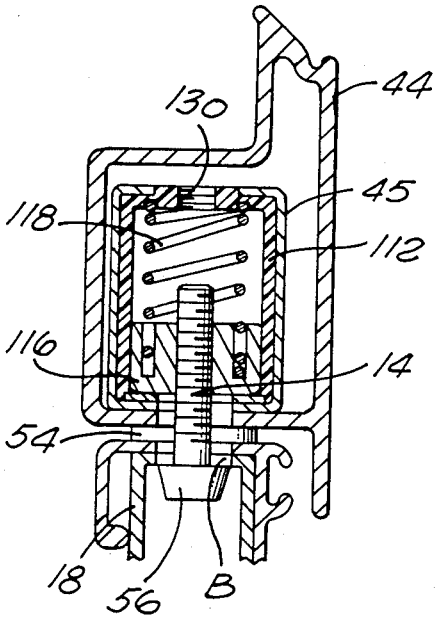
FIG. 16
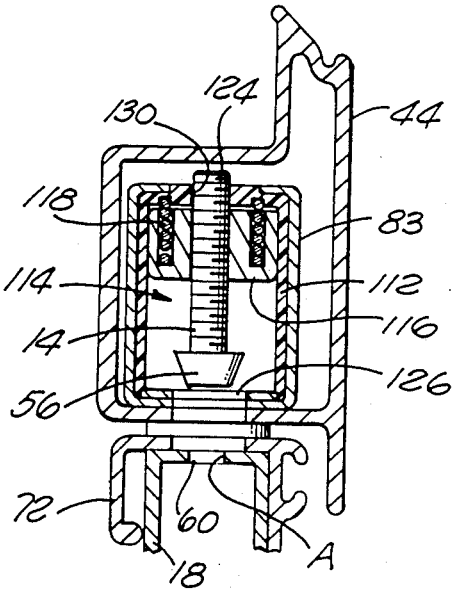
FIG. 17
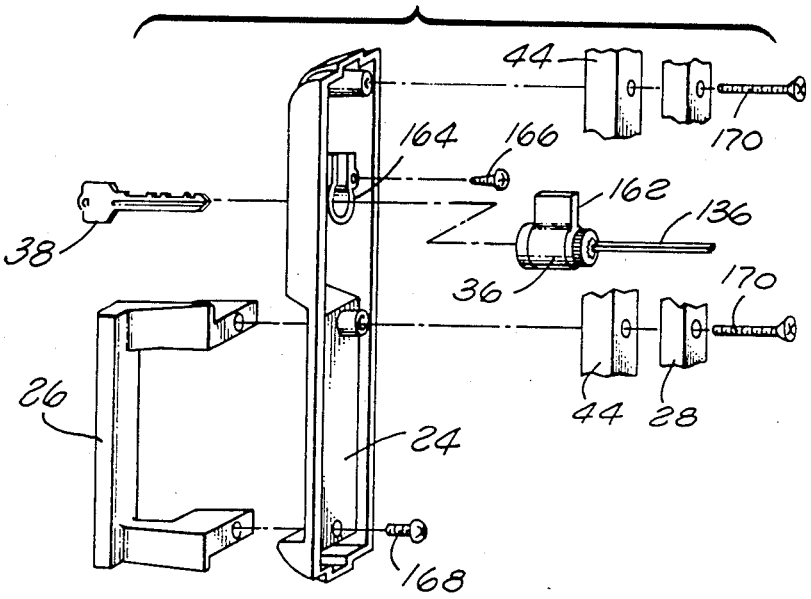
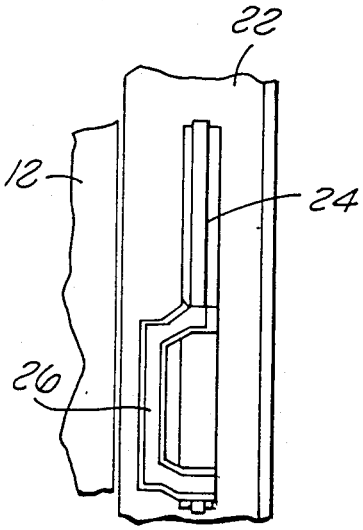
FIG. 18

LOCK ASSEMBLY FOR SLIDING DOORS

BACKGROUND OF THE INVENTION

This invention relates generally to an improved lock assembly for use in secure locking of a sliding door such as a sliding glass patio door or the like. More particularly, this invention relates to an improved high security lock assembly designed to safely and positively lock a patio door or the like against unauthorized entry.

Sliding doors such as sliding glass patio doors and the like are will known in the art and are commonly used in residential dwellings, apartment units and the like. Such sliding glass patio doors typically comprise one or more enlarged glass panes carried in a surrounding metal or wooden frame adapted for sliding movement back and forth upon a lower track or rail. A vertical stile along one edge of the sliding door normally carries a lock assembly adapted for keyless operation from the indoor side of the door, and, if desired, for keyed operation from the outdoor side of the door. This lock assembly typically operates a hook-shaped latch member for selective engagement with a matingly shaped latch keeper mounted on the adjacent door jamb for locking the door against entry.

It is well recognized, however, that sliding glass patio doors of the above-described type are frequently opened relatively easily by unauthorized intruders. More particularly, such sliding glass doors normally ride upon their associated track or rail with sufficient freedom of motion to permit an unauthorized intruder to lift or otherwise shift the door from the track or rail even when the door is locked. Accordingly, it is possible for an intruder to lift or shift the locked door sufficiently from the outdoor side to disengage the latch member from the latch keeper to permit the door to be opened, or, in some instances, to permit the door to be removed entirely from the track or rail.

The prior art includes a wide variety of proposed mechanisms intended to prevent unauthorized opening of an otherwise locked sliding glass patio door. Such mechanisms include, for example, many different types of secondary lock pins and the like which are normally attached to the door as removable items, wherein these secondary lock pins are intended to cooperate with the standard door latch member to improve security in the locked condition by preventing lifting or shifting, etc., of the door from the outdoor side. However, the use of a secondary lock pin on a sliding glass door is relatively inconvenient since such devices must be set in the locked condition separately from the standard latch member, whereby actual locking of the secondary lock pin in often forgotten or disregarded. Moreover, removable secondary lock pins devices are necessarily separated from the door in the unlocked condition and are thus subject to becoming easily lost. Other secondary lock pin devices requiring permanent installation onto the sliding door are not widely used in view of the tools and skills required to achieve a proper permanent installation.

There exists, therefore, a significant need for improvements in locking devices for sliding doors such as sliding glass patio doors and the like. The present invention fulfills these needs and provides further related advantages.

SUMMARY OF THE INVENTION

In accordance with the invention, an improved lock assembly is provided for use with sliding doors, particularly such as sliding glass patio doors and the like. The improved lock assembly includes a lock mechanism for shifting dual latch members toward and away from each other between positively locked and unlocked positions, with the dual latch members securely engaging aligned latch keepers on an adjacent door jamb in the locked position. In accordance with further features of the invention, the lock mechanism is integrated into a compact cartridge adapted for facilitated mounting as a unit into an extruded hollow metal stile or the like of a sliding door, with the lock mechanism further including internal tumblers adapted to resist keyless tampering from the outdoor side of the door.

In the preferred form of the invention, the improved lock assembly comprises a compact cartridge housing having a size and shape to slide quickly and easily into the hollow interior of a metal stile for a sliding door, with the cartridge housing being fixed in place by one or more mounting screws passed, for example, through the end face of the stile. The dual latch members comprise a pair of headed latch pins adapted for releasable retention seated within the cartridge housing, without projecting outwardly therefrom, to permit facilitated cartridge housing reception into the hollow stile interior. Subsequent to installation of the cartridge housing, the latch pins are released for spring-biased projection outwardly through operating slots formed in the stile end face. A lock mechanism also mounted within the cartridge housing is operable for displacing the latch pins in unison respectively toward and away from each other, between the locked and unlocked positions, for appropriate selective locking engagement with key hole-shaped latch keepers on the adjacent door jamb. In the preferred form, the lock mechanism is adapted for keyed operation from the outdoor side of the door and for keyless operation from the indoor side of the door.

The lock mechanism mounted within the cartridge housing includes a rotatable tumbler gear having external teeth engaged on diametrically opposite sides of the tumbler gear with a respective pair of elongated racks which are respectively coupled in turn with the dual latch pins. Accordingly, rotation of the tumbler gear is effective to displace the latch pins in unison toward or away from each other, in accordance with the direction of tumbler gear rotation. Spring means are beneficially provided in the connection between the racks and their respective latch pins to provide the connection with at least some resiliency, thereby protecting against component breakage upon attempted forced movement of the latch pins between the locked and unlocked positions.

The tumbler gear is rotated by an actuator blade extending between outdoor and indoor accessible lock operators forming portions of the lock assembly. The actuator blade fits relatively loosely through a central slot in the tumbler gear and further extends with a relatively snug fit through an aligned central slot in a control tumbler having ramped external teeth engaging radially inwardly projecting spring-loaded set pins. Initial rotation of the actuator blade for lock mechanism operation is effective first to rotate the control tumbler due to the snug blade fit with the central slot therein, with control tumbler rotation in the correct direction displacing the set pins radially outwardly along the ramped teeth toward disengagement from said ramped teeth. Further actuator blade rotation then rotates the tumbler gear for appropriately displacing the two latch pins in unison. Attempted actuator blade rotation in the incorrect direction is prevented by the shapes of the control tumbler teeth which remain in locked engagement with the spring-loaded set pins.

In accordance with further features of the invention, the lock assembly includes indoor and outdoor escutcheons adapted for rapid assembly with the installed cartridge housing by means of elongated mounting screws or the like passed normally from the indoor side of the door into engagement with the two escutcheons. Each escutcheon includes a handle having a size and shape for easy manual grasping to slide the door between opened and closed positions. One or both of these handles may be reversibly mounted upon the associated escutcheon to correspondingly permit reversible lock assembly installation onto the left-hand or right-hand stile of a sliding door.

Other features and advantages of the present invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 15 is an enlarged fragmented horizontal sectional view similar to FIG. 12 but illustrating the latch pin in an unlocked position with the door in a closed position;

FIG. 16 is an enlarged fragmented horizontal sectional view similar to FIG. 12 but illustrating the latch pin temporarily retained in a position recessed within the lock assembly cartridge to permit cartridge installation;

FIG. 17 is a fragmented exploded perspective view illustrating assembly and mounting of an outdoor escutcheon onto the door, with said escutcheon including a reversibly mounted handle;

FIG. 18 is a fragmented outdoor side elevation view illustrating the handle in a reversed position relative to the position shown in FIGS. 1 and 17;

DETAILED DESCRIPTION OF THE PREFERRED EMBODIMENT

Figure 1:
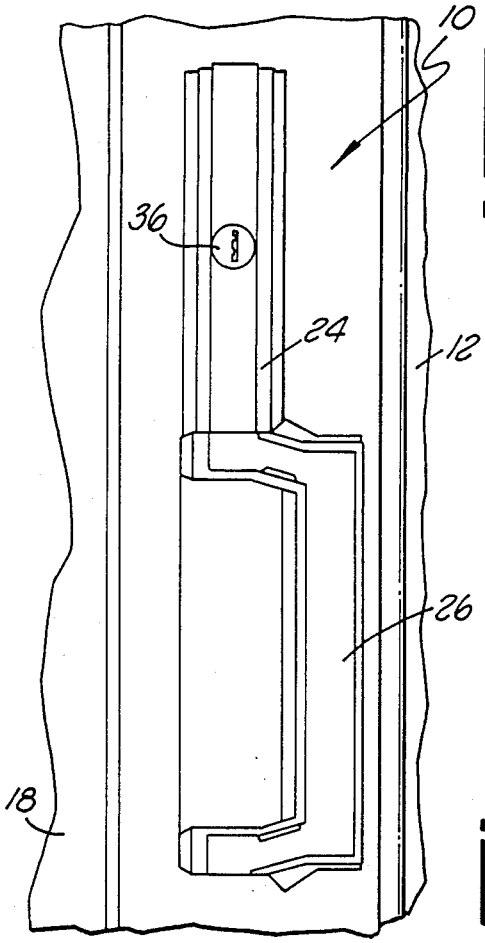
FIG. 1 is a fragmented outdoor side elevation view depicting an improved lock assembly embodying the novel features of the invention and showing the lock assembly installed onto a vertical door stile of a sliding door.
Figure 2:
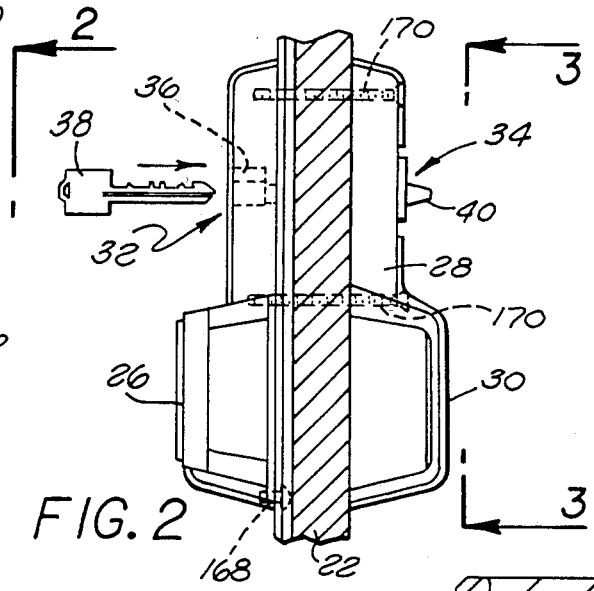
FIG. 2 is a fragmented vertical sectional view taken generally on the line 2—2 of FIG. 1.
Figure 3:
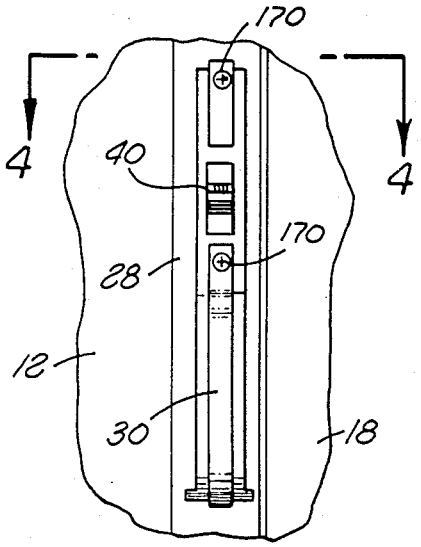
FIG. 3 is a fragmented vertical elevational view illustrating the lock assembly from the indoor side of the sliding door, taken generally on the line 3—3 of FIG. 2.
Figure 4:
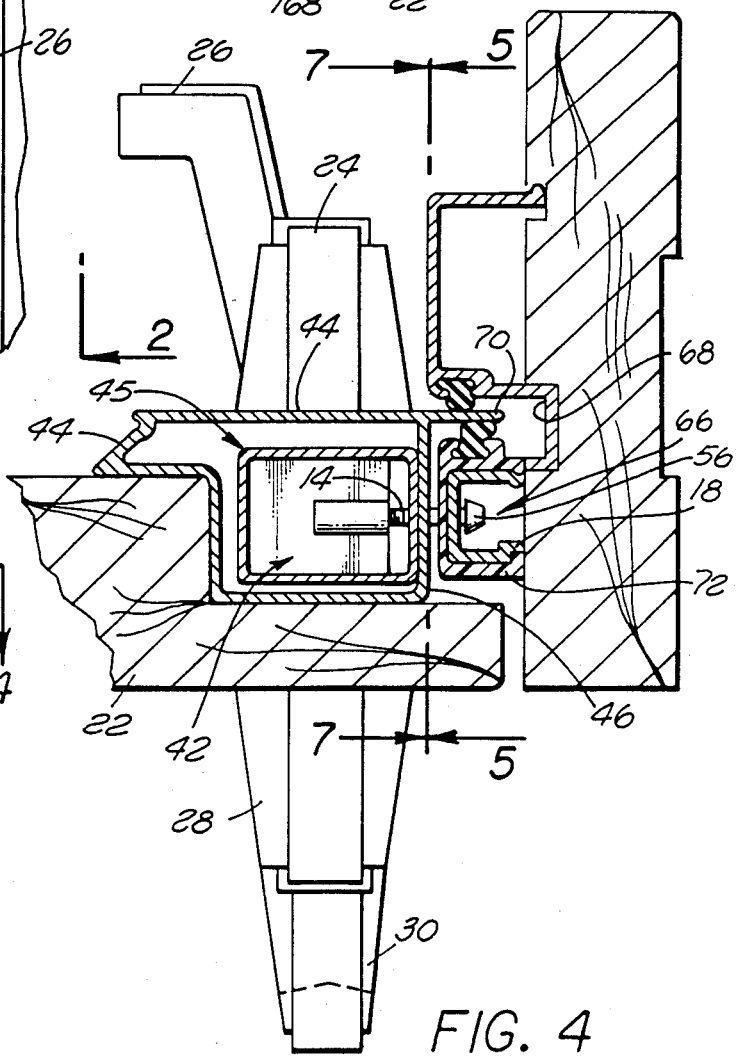
FIG. 4 is an enlarged fragmented horizontal sectional view taken generally on the line 4—4 of FIG. 3.

As shown in the exemplary drawings, an improved lock assembly referred to generally by the reference numeral 10 in FIGS. 1–4 is provided for positive and high security locking of a sliding door 12 such as a sliding glass patio door or the like. The lock assembly 10 includes dual latch members such as the illustrative latch pins 14 and 16 shown in FIGS. 4–6, wherein the dual latch members are movable in unison toward and away from each other between locked and unlocked positions for selective locked engagement with a latch keeper 18 mounted on the adjacent door jamb 20.

The improved lock assembly 10 of the present invention is designed particularly for use with sliding glass patio doors of the type commonly used in residential dwellings, apartment units, etc. Such sliding doors typically include a generally rectangular door frame 22 normally encasing one or more enlarged glass panes (not shown), with FIGS. 1–4 illustrating a portion of said frame 22 defining a vertically extending stile at one side edge of the door. The lock assembly 10 is incorporated into this vertical stile for selective locking association with the latch keeper 18 on the adjacent door jamb 20 when the door is in the closed position. Importantly, the dual latch members 14 and 16 cooperatively engage the latch keeper member 18 in a manner positively locking the door 12 against unauthorized opening and/or removal, including but not limited to attempts by intruders to lift the door 12 out of its normal slidably mounted position closing the associated entrance into the residential dwelling or apartment.

As shown generally in FIGS. 1–4, the improved lock assembly 10 includes an outdoor escutcheon 24 having a handle 26 and securely mounted onto the outboard side of the vertical stile 22. The lock assembly further includes an indoor escutcheon 28 with an appropriate handle 30 secured to the inboard side of the stile 22. The outdoor and indoor escutcheons 24 and 28 include respective lock operators 32 and 34, such as the illustrative lock cylinder 36 for outdoor side access with a conventional key 38, and a thumb-operated slide switch 40 exposed on the indoor side of the door. Both lock operators 32 and 34 are operatively associated with a lock mechanism 42 (FIG. 4) incorporated into the vertical stile 22 for displacing the dual latch members 14 and 16 between the locked and unlocked positions, as will be described. Conveniently, this lock mechanism 42 is shown in the form of a compact cartridge adapted for facilitated and direct installation into the hollow interior of an upright metal extrusion 44 forming an integral component of the vertical stile 22. Accordingly, the compact cartridge permits all or part of the stile 22 to be defined by economic extruded metal components.

Figures 5, 6, 7:
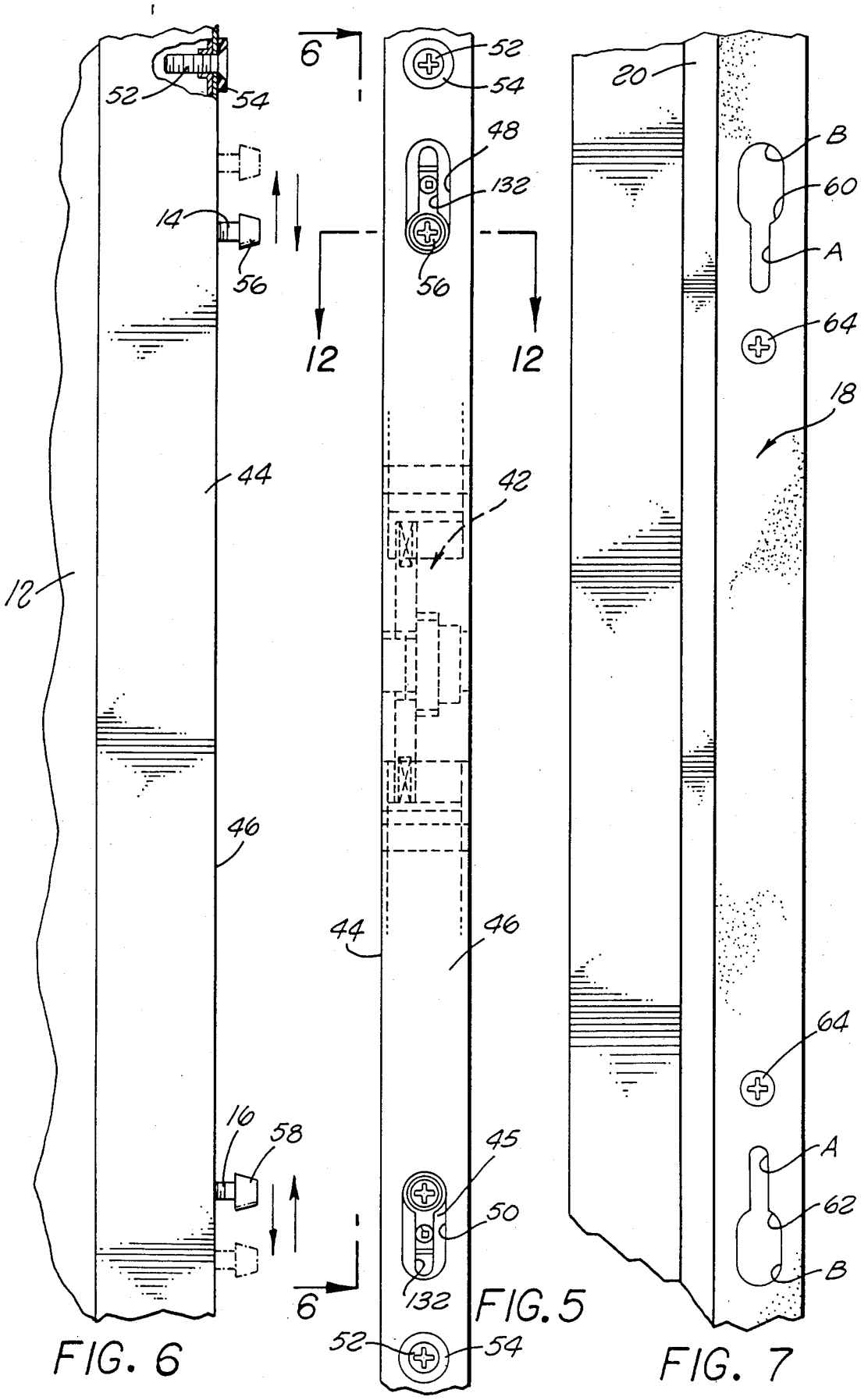
FIG. 5 is a fragmented end elevational view of the sliding door having the improved lock assembly mounted therein, taken generally on the line 5—5 of FIG. 4.
FIG. 6 is a fragmented indoor side elevational view of a portion of the sliding door taken generally on the line 6—6 of FIG. 5.
FIG. 7 is an enlarged fragmented elevational view taken generally on the line 7—7 of FIG. 4 and depicting a latch keeper mounted on an adjacent door jamb for interlocking with the improved lock assembly.

The compact cartridge for the lock mechanism 42 comprises an elongated hollow cartridge housing 45 having a size and shape for smooth sliding reception into the metal stile extrusion 44 with the latch members or latch pins 14 and 16 oriented to project outwardly from the stile end face 46 respectively through upper and lower, vertically elongated operating slots 48 and 50, as viewed best in FIG. 5. The latch pins 14 and 16 are initially temporarily retained in positions recessed within the cartridge housing 45, in a manner to be described in more detail, to permit cartridge housing installation into the metal stile extrusion 44, after which the latch pins are released to project outwardly through the slots 48 and 50. Mounting screws 52 are fastened through the stile end face 46 and into the cartridge housing 45 to hold said housing 45 and lock mechanism 42 therein in the desired position for operation. These mounting screws 52 conveniently have their heads countersunk into plastic washers 54 of an appropriate material to provide spacing and at least some cushion effect upon impact with the adjacent door jamb 20 when the door is closed.

The two latch pins 14 and 16 respectively include enlarged heads 56 and 58 each having a size and shape for appropriate reception into and interlocking engagement with an associated one of a pair of keyhole-shaped keeper ports 60 and 62 formed in the latch keeper 18 on the door jamb 20. More particularly, as shown best in FIGS. 4 and 7, the latch keeper 18 comprises a vertically elongated metal extrusion or the like fastened by screws 64 or other suitable mounting means onto the adjacent door jamb 20. This extrusion has the keeper ports 60 and 62 formed therein and opening into a shallow chamber 66 (FIG. 4) behind the exposed side of the extrusion for reception of the latch pin heads 56 and 58. If desired, as viewed in FIG. 4, the keeper extrusion may also include a vertical slot 68 for receiving a concealment lip 70 of the metal stile extrusion 44 when the door is closed. An overlying cushion strip 72 may also be provided on the latch keeper 18 for cushioning closure impact with the stile end face 46.

The vertically aligned keeper ports 60 and 62 each have a generally keyhole shape to include a relatively narrow slot region referred to by the letter A and opening into a wider, oval-shaped passage referred to be the letter B. The ports 60 and 62 are oriented, as shown in the illustrative embodiment, with their respective narrow slot regions A projecting toward each other and opening in directions away from each other into the larger passages B. Accordingly, as will be described in more detail, movement of the latch pins 14 and 16 in unison toward and away from each other is effective to move the pins together into association with the narrow slot regions A or the wider passages B.

When the door 12 is closed, the two latch pins 14 and 16 including their respective heads 56 and 58 are receivable without interference into the enlarged openings or passages B of the two keeper ports 60 and 62. In this closed position, the latch pine 14 and 16 are oriented with their heads 56 and 58 projecting at least slightly into the hollow internal chamber 66 (FIG. 4) behind the latch keeper 18. Operation of the lock mechanism 42 is then effective to move the latch pins 14 and 16 from the unlocked position (shown in dotted lines in FIG. 6) in a direction toward each other to a locked position (shown in solid lines in FIG. 6) to correspondingly displace the enlarged heads 56 and 58 of the latch pins to locked positions seated behind the narrow slot regions A of the two keeper ports. In this position, the latch pin heads prevent opening of the door 12 unless and until the lock mechanism 42 is again appropriately operated to displace the latch pins 14 and 16 away from each other, back to the unlocked position (shown in dotted lines in FIG. 6).

The compact lock assembly cartridge including the cartridge housing 45 and the lock mechanism 42 are shown in more detail in FIGS. 8–11. More specifically, the cartridge housing 45 comprises a central casing 74 defined by outer and inner casing members 75 and 76 having interfitting or interlocking bosses 77 and 78, respectively, presented toward each other. The longitudinal side margins of the outer and inner casing members 75 and 76 include side flanges 79 and 80, respectively, for cooperatively defining a pair of slide tracks for guided sliding retention of a pair of elongated racks 81 and 82, wherein these racks 81 and 82 are operatively coupled with the latch pins 14 and 16, as will be described in more detail. The opposite ends of the outer and inner casing members 75 and 76 are held or clamped relative to each other by sliding reception of said opposite ends into a respective pair of generally U-shaped channel members 83 and 84, as shown best in FIG. 8. Spring loaded tabs 86 on the outer casing member 76 are positioned for snap-fit reception into openings 88 in one side wall of the channel members 83 and 84 to hold the assembled components in position with respect to each other. Press-fit anchor pins 90 are also desirably seated through associated openings 92 in the channel members 83 and 84 and further through the aligned interfitting bosses 77 and 78 to hold the assembled components together.

The elongated racks 81 and 82 include perforated driven ends retained by the side flanges 79 and 80 in meshed relation with a rotatable tumbler gear 94 which is rotatably supported in turn between the casing members 75 and 76. From the tumbler gear 94, these racks 81 and 82 extend in opposite directions from the central casing 74 respectively into the channel members 83 and 84, as shown with respect to the rack 81 in FIG. 11. The distal end of each rack includes a spring pocket 96 for receiving a compression spring 98 between proximal and distal stops 100 and 102. The spring procket 96 is bordered by angled retainer lips 104 for snap-fit reception through elongated passages 106 in a mating slide component 108. This slide component 108 also includes a proximal stop 110, thereby permitting sliding movement of the slide component 108 along the spring pocket 96 a short distance away from the rack 81 and central casing 74, and against the compressive forces applied by the spring 98. This permission of some sliding movement assists in preventing breakage of the components during latch pin displacement between the locked and unlocked positions.

Figure 11:
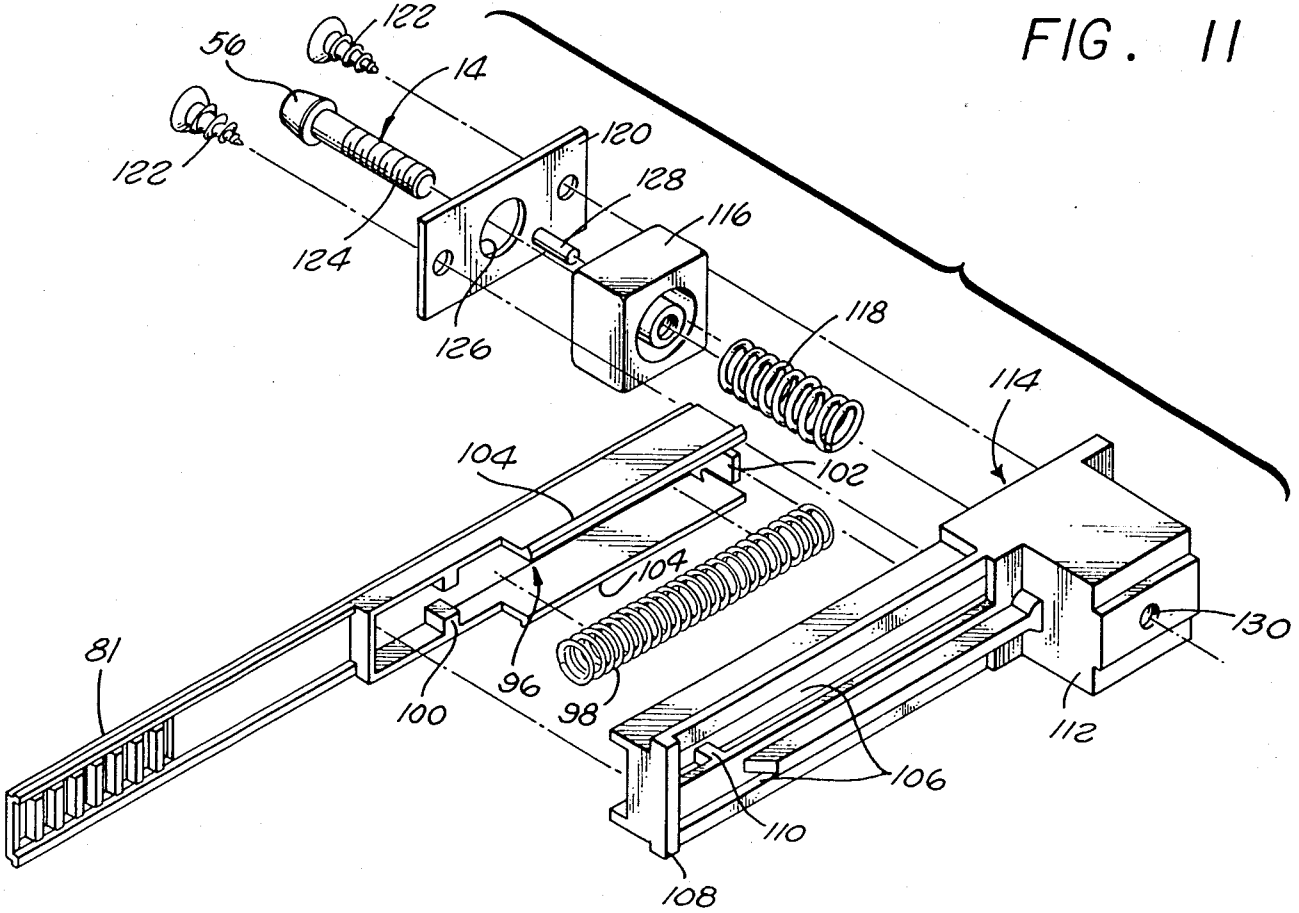
FIG. 11 is an enlarged exploded perspective view illustrating further construction and assembly details for the lock mechanism.

As shown further in FIG. 11 with respect to the latch pin 14, the distal end of the slide component 108 includes an enlarged hollow cap 112 which opens in a direction toward the stile end face 46 (FIG. 4) of the stile extrusion 44. This cap 112 defines an internal chamber 114 for receiving a nonrotatable slide nut 116 therein, with a pin biasing spring 118 captured between a rear wall of the cap 112 and the slide nut 116 for urging the slide nut in a direction out of the cap chamber 114. A forward retainer plate 120 is secured by screws 122 or the like onto the cap 112 to retain the slide nut 116 within the chamber 114. The latch pin 14 includes a threaded shank 124 received through a central opening 126 in the retainer plate 120 and threaded into the slide nut 116, with an antirotation pin 128 being received with interference fit between the latch pin shank 124 and a threaded bore in the slide nut for normally holding the latch pin against rotational adjustment relative to the slide nut.

For initial assembly of the cartridge, including the cartridge housing 45 and the lock mechanism 42 into the stile extrusion 44, the latch pins 14 and 16 can be releasably retained in positions recessed into their respective cap chambers 114, as illustrated by way of example in FIG. 16 with respect to the latch pin 14. More particularly, the head 56 of the latch pin 14 conveniently includes appropriate screwdriver slots or the like for screwdriver engagement and advancement against the spring 118 to a position with the pin shank 124 bearing against a threaded bore 130 in the rear cap wall. Rotation of the pin 14 in this position advances the pin into the threaded bore 130, thereby retaining the pin recessed into the chamber 114, as viewed in FIG. 16. In this position, the pins do not obstruct cartridge installation into the metal extrusion 44. After cartridge installation and appropriate installation of the related mounting screws 52 (FIG. 5), the latch pin heads 56 and 58 are exposed through channel member ports 132 (FIGS. 5 and 10) for appropriate rotation, releasing the pins from the respective threaded bores 130 in the associated cap rear wall. When released from the bores 130, the springs 118 urge the latch pins 14 and 16 to project outwardly through the stile end face 46 for appropriate locking engagement with the latch keeper 18, as previously described.

The tumbler gear 94 is rotatably supported within the central casing 74 (FIG. 8) with its outwardly projecting gear teeth 134 meshed with the racks 81 and 82 for displacing the latch pins 14 and 16 in unison toward or away from each other, between the locked and unlocked positions. This tumbler gear is rotatably operated by an elongated actuator blade 136 extending through a central slot 138 in the tumbler gear in both directions for respective operative association with the outdoor lock cylinder 36 and the indoor slide switch 40. However, free rotation of the tumbler gear 94 is prevented by a coaxially mounted control gear 140 having a central slot 142 which also receives the actuator blade 136. In the illustrative embodiment, the control gear 140 includes outwardly radiating ramped teeth 144 seated within a circular cavity 146 in the inner casing member 76, with the control gear 140 having a relatively small diameter cylindrical hub projecting axially into a larger diameter cylindrical hub of the tumbler gear 94. An outboard end of the tumbler gear 94 in turn has a somewhat reduced diameter for rotatably supported reception into a central opening 148 in the outer casing member 75. Accordingly, the two tumbler components 94 and 140 support each other for rotatable movement between the casing members 75 and 76. However, prevention of rotation of either the control gear 140 or the tumbler gear 94 results in nonrotation of both gears due to their common connection to the actuator blade 136.

Figures 8, 9, 10:
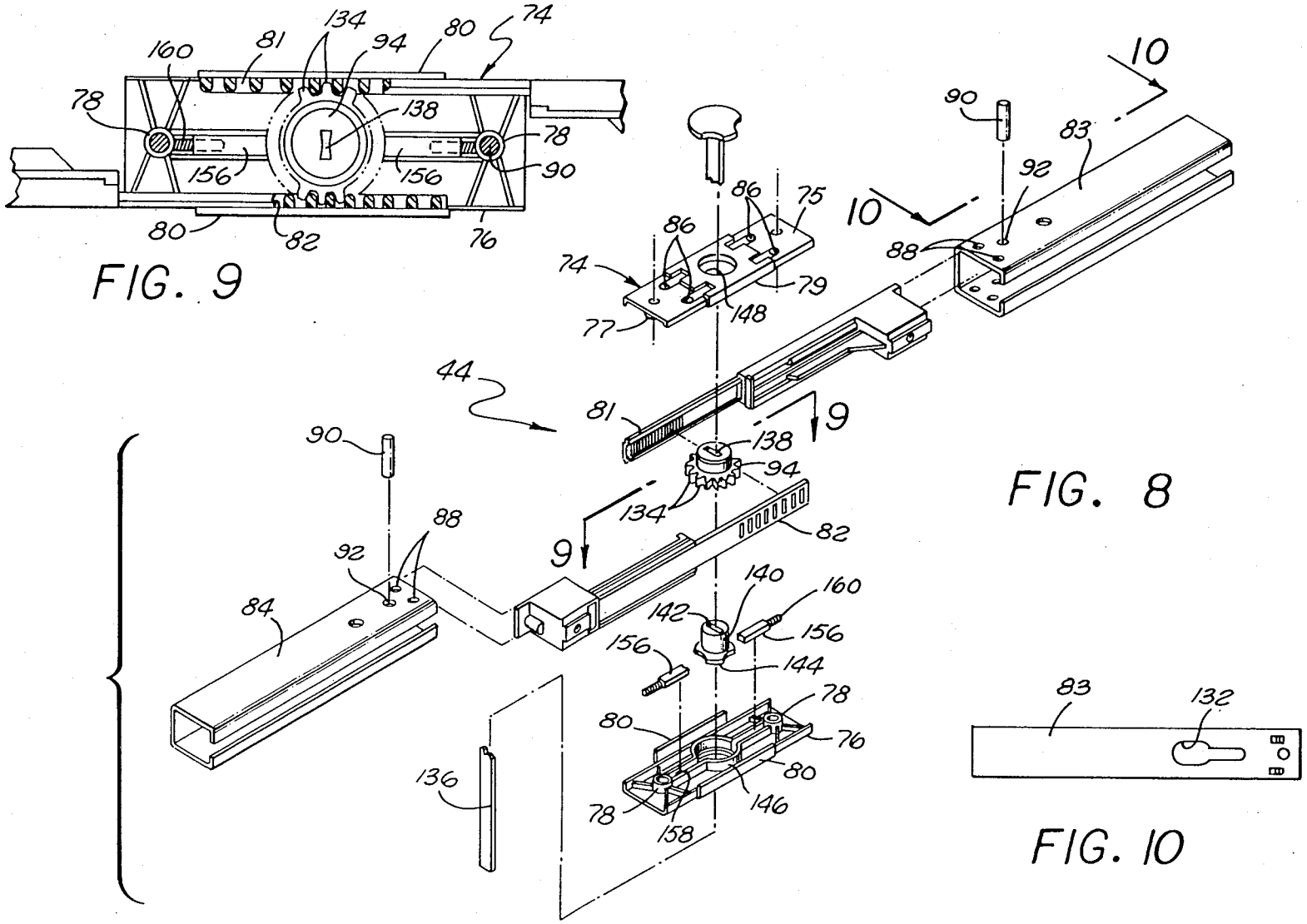
FIG. 8 is an exploded perspective view illustrating construction and assembly of a lock mechanism comprising a portion of the improved lock assembly and integrated into a compact cartridge.
FIG. 9 is an enlarged fragmented view of a portion of the lock mechanism taken generally on the line 9—9 of FIG. 8.
FIG. 10 is an elevational view taken generally on the line 10—10 of FIG. 8 and depicting a portion of the lock mechanism cartridge.
Figure 19:
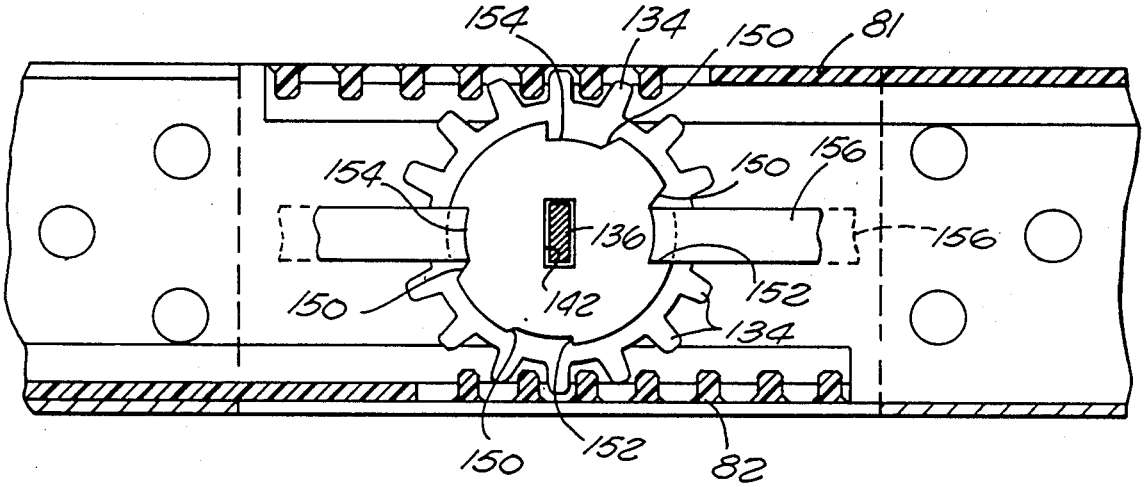
FIG. 19 is an enlarged fragmented and somewhat diagrammatic view illustrating the operation of tumbler components for the lock mechanism.

As shown best in FIG. 19, the outwardly radiating teeth 144 of the control gear 140 include specifically tailored side faces to control or limit rotation of the tumbler components for shifting the latch pins 14 and 16 between the locked and unlocked positions. More particularly, two of the teeth 144 include ramped side faces 150 and the remaining two teeth include side faces 152 projecting outwardly on a radius for the control gear. Together, the four teeth define four intertooth seats 154 for receiving the ends of a diametrically opposed pair of spring-loaded set pins 156 (FIGS. 8, 9 and 19). These set pins are guided in tracks 158 on the outer casing member 76 and urged by springs 160 into engagement with the control gear seats 154. Accordingly, unless these set pins 158 are retracted from the outwardly open seats in the control gear 140, rotational movement of the control gear as well as the tumbler gear 94 is prevented.

The actuator blade 136 projects through the control gear slot 142 with relatively tight clearance. However, the blade 136 projects through the central slot 138 of the tumbler gear 94 with a significantly looser fit, said slot 138 having a generally butterfly configuration, as viewed best in FIG. 9. Accordingly, initial rotation of the actuator blade 136 in one rotational direction causes the set pins 156 to ride on the ramped faces 150 of the teeth 144 to positions retracted from the control gear seats 154. When so retracted, actuator blade rotation may continue to initiate rotation of the tumbler gear 94, thereby shifting the latch pins 14 and 16 from the locked to the unlocked position, or vice versa. Importantly, the nonramped radial faces 152 on the other control gear teeth prevent rotation of the tumbler components beyond about ninety degrees, while the ramped faces 150 permit reverse rotation through the ninety degree increment. Accordingly, the control gear 140 permits tumbler component rotation first in one direction to shift the latch pins, for example, from the locked to the unlocked position, and subsequently in the opposite direction for reverse latch pin movement.

As shown in FIG. 17, the outboard or outdoor end of the actuator blade 136 projects into operational association with the outdoor lock cylinder 36. This lock cylinder, in accordance with conventional mounting techniques, has a generally cylindrical configuration interrupted by an outwardly radiating wing 162 for unipositional reception into a mating bracket 164 on the concealed side of the outdoor escutcheon 24. A set screw 166 is normally provided for retaining the lock cylinder 36 in place, with the outboard face of the cylinder exposed through the escutcheon (FIG. 1) for appropriate key operation.

In addition, as also viewed in FIG. 17, the outdoor escutcheon 24 includes means for reversible mounting of the outdoor handle 26, thereby permitting use of the lock assembly 10 for left-hand or right-hand door operation without requiring additional lock components. In particular, the outdoor handle 26 has a generally U-shaped configuration for removable seating onto the escutcheon 24, with one anchor screw 168 being receivable from the concealed side of the escutcheon 24 to secure the handle 26 in the desired position, with the alternative or reversed position being illustrated in FIG. 18. The upper end of the outdoor handle 26 is appropriately locked in place by one of a pair of elongated mounting screws 170 passed through the indoor escutcheon 28 and the stile extrusion 44.

Figure 20:
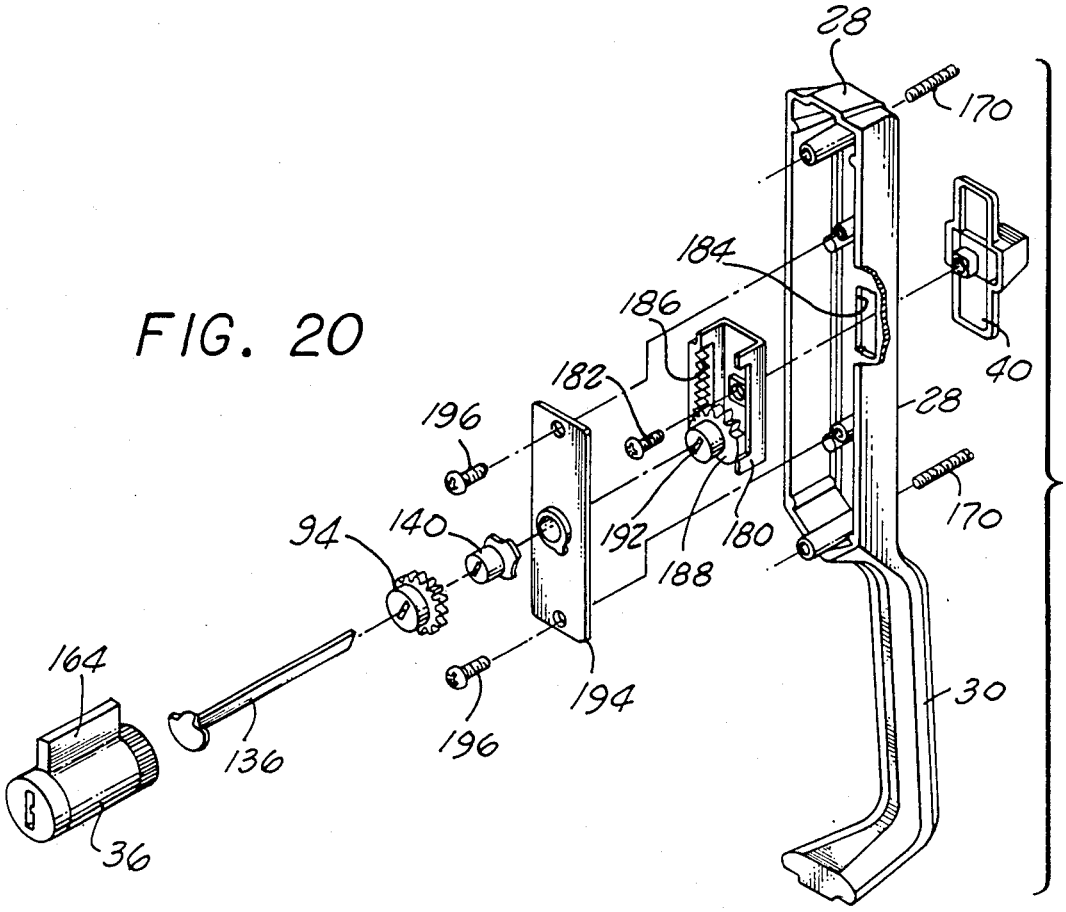
FIG. 20 is an exploded perspective view illustrating assembly and mounting of an outdoor escutcheon for the lock assembly onto the sliding door.

The inboard or indoor end of the actuator blade 136 extends into operative engagement with the slide switch 40 on the indoor escutcheon 28. More particularly, as viewed in FIG. 20, the indoor escutcheon includes a concealed cavity having a generally U-shaped bracket 180 disposed therein and secured by a screw 182 or the like to the thumb-activated slide switch 40 through an appropriate opening 184 in the escutcheon. Up or down movement of the slide switch 40 appropriately shifts the bracket 180 in the same direction to correspondingly displace a vertical rack of teeth 186 on the bracket. These teeth 186 are meshed with a slide switch gear 188 which has a central slot 192 receiving the end of the actuator blade 136. A cover plate 194 is conveniently mounted over the bracket 180 and slide switch gear 188 by screws 196 or the like to retain this subassembly in place.

In operation, up or down motion of the slide switch 40 is accompanied by a corresponding rotation of the slide switch gear 188 to correspondingly rotate the actuator blade in the desired direction. Such actuator blade rotation, as previously described, rotates the control gear 140 and tumbler gear 94 within the lock mechanism 42 to displace the latch pins 14 and 16 in the desired direction.

Figure 12:
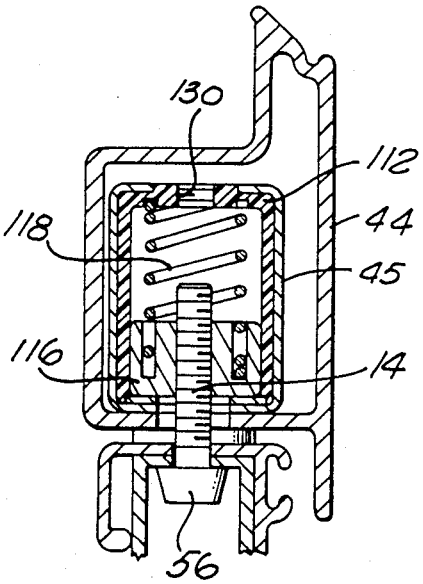
FIG. 12 is an enlarged fragmented horizontal sectional view taken generally on the line 12—12 of FIG. 5 and depicting one of dual latch pins in a locked position engaged with the latch keeper on the adjacent door jamb.

Operation of the latch pins for locking the door 12 is shown best in FIGS. 12–15. More particularly, as shown in FIG. 12, appropriate latch pin displacement toward each other to the locked position effectively captures the heads 56 and 58 of the two latch pins in the narrow slot regions A of the respective keeper ports 60 and 62. In this position, opening of the door 12 is prevented. Moreover, attempts to dislodge the door from its external frame, for example, by upward lifting of the door, is positively prevented since at least one of the two latch pins is moved further into the narrow slot region A upon attempted displacement of the door in either vertical direction.

Figure 13:
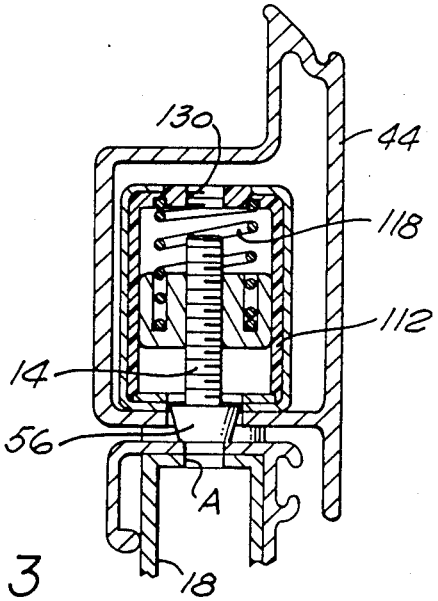
FIG. 13 is an enlarged fragmented horizontal sectional view similar to FIG. 12, but illustrating latch pin operation in the locked position during attempted closure of the sliding door from an open position.
Figure 14:
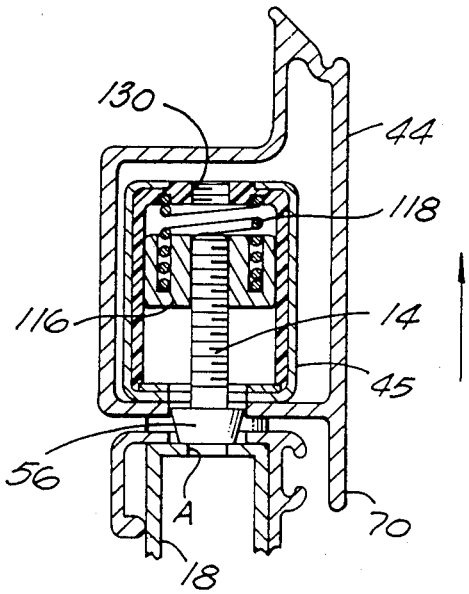
FIG. 14 is an enlarged fragmented horizontal sectional view similar to FIG. 13 and illustrating further latch pin operation in the locked position to reopen the door upon attempted closure of the door as shown in FIG. 13.

Alternatively, with the latch pins in the locked positions but the door remaining in an open position as viewed in FIG. 13, the latch pins will impact the exterior of the latch keeper 18 in alignment with the narrow slot regions A of the ports 60 and 62. Accordingly, the latch pins 14 and 16 will not pass through the ports. Self-latching of the door, as by inadvertent door closure with the latch pins in the locked position, is thereby prevented. Instead, such attempted closure causes the pin heads 56 and 58 to retract partially against their respective springs 118, with the result that the compressed springs rebound the door from the latch keeper 18 to slightly open the door, as viewed in FIG. 14. Accordingly, the door gives positive indication that positive locking has not occurred. However, with the latch pins 14 and 16 in the unlocked position as viewed in FIG. 15, the latch pin heads 56 and 58 pass freely without interference through the wider port regions B thereby permitting unrestricted opening and closing of the door as desired.

The improved lock assembly of the present invention thus provides a highly effective apparatus for securely locking a sliding door against unauthorized entry. The lock assembly is conveniently adaptable for right-hand or left-hand door operation by relatively quick and easy reversal of the outdoor handle 26 on the outdoor escutcheon 24. When installed, the dual latch pins 14 and 16 are displaced toward and away from each other to achieve positive and high security door locking with relatively easy unlocking in a single motion. Moreover, the tumbler components 94 and 140 are adapted to prevent latch pin displacement in the absence of full through-passage of the actuator blade 136, thereby providing the lock mechanism with improved resistance to external tampering and keyless unlocking, for example, the event of actuator blade removal from the tumbler components.

A variety of modifications and improvements to the invention described herein will be apparent to those skilled in the art. Accordingly, no limitation is intended by way of the description herein, except as set forth in the appended claims.

What is claimed is:

1. A lock assembly for use in locking a sliding door or the like having a stile movable with the door between open and closed positions relative to an adjacent door jamb, said lock assembly comprising:

a lock mechanism for mounting on the door stile, said lock mechanism including at least two latch members projecting outwardly from the stile in directions extending generally toward the jamb, and means for selectively displacing said at least two latch members generally toward and away from each other between locked and unlocked positions; and a latch keeper for stationary mounting on the door jamb, said latch keeper including means for receiving said latch members in unlocked relation therewith when said latch members are in the unlocked positions and the door is closed, said latch keeper further including means for locked engagement with said latch members when the door is closed and said latch members are moved from the unlocked position to the locked position.

2. The lock assembly of claim 1 wherein said means for selectively displacing said latch members comprises means for displacing said latch members together toward and away from each other.

3. The lock assembly of claim 1 wherein the door has indoor and outdoor sides, said means for displacing said latch members being operable from at least the indoor side of the door.

4. The lock assembly of claim 3 wherein said means for displacing said latch members is accessible from the indoor and outdoor sides of the door.

5. The lock assembly of claim 3 further including handle means accessible on the indoor and outdoor sides of the door, said handle means being reversible on at least one of the indoor and outdoor sides for selective left-hand and right-hand door operation.

6. The lock assembly of claim 1 wherein said at least two latch members comprise a pair of latch pins projecting outwardly from said lock mechanism, each of said latch pins having a narrow shank and an enlarged head, and wherein said latch keeper includes a pair of open ports respectively aligned with said latch pins, each of said ports having a relatively wide region for receiving the head of the the associated latch pin and a relatively narrow region for receiving the shank of the associated latch pin without permitting passage of the latch pin head, said latch pins being aligned in the unlocked position with said wide port regions for reception of said heads therethrough and then movable to said locked position in alignment with said narrow port regions.

7. The lock assembly of claim 6 wherein said latch pins are movable toward each other to the locked position and away from each other to the unlocked position.

8. The lock assembly of claim 1 wherein said lock mechanism comprises a tumbler gear, means supporting said tumbler gear for rotation, said means for selectively displacing said latch members comprising means for rotating said tumbler gear, said lock mechanism further including first and second racks meshed with said tumbler gear respectively on opposite sides thereof and respectively coupled to a pair of said latch members for displacing said latch members in opposite directions upon rotation of said tumbler gear.

9. The lock assembly of claim 8 further including resilient means interconnecting each of said first and second racks with the respective one of said latch members.

10. A lock assembly for use in locking a sliding door or the like having a stile movable with the door between open and closed positions relative to an adjacent door jamb, said lock assembly comprising:

a lock mechanism for mounting on the door stile, said lock mechanism including at least two latch members and means for selectively displacing said at least two latch members generally toward and away from each other between locked and unlocked positions, said lock mechanism including a tumbler gear, means supporting said tumbler gear for rotation, said means for selectively displacing said latch members comprising means for rotating said tumbler gear, said lock mechanism further including first and second racks meshed with said tumbler gear respectively on opposite sides thereof and respectively coupled to a pair of said latch members for displacing said latch members in opposite directions upon rotation of said tumbler gear; and a latch keeper for mounting on the door jamb, said latch keeper including means for locking engagement by said latch members when said latch members are in the locked position and the door is closed;

said lock mechanism further including a control gear, means for rotatably supporting said control gear generally coaxially with said tumbler gear, means for restricting rotation of said control gear to back and forth rotation within a predetermined rotational increment, and actuator means coupled between said tumbler gear and said control gear and coupled further to said latch member displacing means for rotating said tumbler and control gears back and forth through said rotational increment to displace said latch members between said locked and unlocked positions.

11. The lock assembly of claim 10, wherein said actuator means comprises an elongated actuator blade extending with relatively loose fit through a slot formed in said tumbler gear and extending with a relatively tight fit through a slot formed in said control gear, said control gear rotation restricting means comprising releasable means for preventing rotation of said tumbler gear beyond said predetermined increment and releasable upon initial rotation of said control gear within said predetermined increment to permit such rotation.

12. A lock assembly for use in locking a sliding door or the like having a stile movable with the door between open and closed positions relative to an adjacent door jamb, said lock assembly comprising:

a lock mechanism for mounting on the door stile, said lock mechanism including at least two latch members and means for selectively displacing said at least two latch members generally toward and away from each other between locked and unlocked positions; and a latch keeper for mounting on the door jamb, said latch keeper including means for locking engagement by said latch members when said latch members are in the locked position and the door is closed;

said door stile comprising a hollow extrusion, said lock mechanism being mounted within a cartridge housing for reception into the hollow extrusion, said hollow extrusion having openings therein for normal outward projection of said latch members during movement of said latch members between said locked and unlocked positions, and further including means for releasably securing said latch members in positions recessed into said cartridge housing to permit installation of said cartridge housing into said extrusion.

13. A lock assembly for use in locking a sliding door or the like having a stile movable with the door between open and closed positions relative to an adjacent door jamb, said lock assembly comprising:

a lock mechanism for mounting on the door stile, said lock mechanism including at least two latch members and means for selectively displacing said at least two latch members generally toward and away from each other between locked and unlocked positions; and a latch keeper for mounting on the door jamb, said latch keeper including means for locking engagement by said latch members when said latch members are in the locked position and the door is closed;

said lock mechanism including spring means for urging said latch members toward a normal position projecting outwardly from the door stile.

14. A lock assembly for use in locking a sliding door or the like having a stile member movable with the door between open and closed positions relative to an adjacent door jamb, said lock assembly comprising:

a pair of latch pins for mounting on the stile to project outwardly therefrom in a direction toward the jamb, each of said pins having an enlarged head at the distal end thereof;

a latch keeper mounted on the door jamb and having a pair of generally keyhole shaped ports in respective general alignment with said latch pins, each of said ports having a wider region for receiving the head of the pin aligned therewith and a narrower region to receive the pin aligned therewith without permitting passage of the head of said pin; and a lock mechanism including means for displacing said latch pins in unison toward and away from each other between locked and unlocked positions, said latch pins being aligned in the unlocked position with the wider regions of said ports and being aligned in the locked position with the narrower regions of said ports.

15. A lock assembly for use in locking a sliding door or the like having a hollow stile member movable with the door between open and closed positions relative to an adjacent door jamb, said lock assembly comprising:

a relatively compact cartridge housing having a size and shape for reception into the hollow stile member;

a lock mechanism mounted within said cartridge housing, said lock mechanism including a pair of latch pins normally projecting outwardly from said cartridge housing and further through openings in the stile member in a direction toward the jamb, means for displacing said latch pins in unison generally toward and away from each other between locked and unlocked positions, and releasable means for temporarily retaining said latch pins recessed within said cartridge housing to permit installation of said lock mechanism into the stile member; and a latch keeper on the door jamb including means for releasable locked engagement with said latch pins when the door is closed and said latch pins are moved to the locked position.

16. A lock assembly for use in locking a sliding door or the like having a hollow stile member movable with the door between open and closed positions relative to an adjacent door jamb, said lock assembly comprising:

a relatively compact cartridge housing having a size and shape for reception into the hollow stile member;

a lock mechanism mounted within said cartridge housing and including a pair of latch pins normally projecting outwardly from said cartridge housing and further through openings in the stile member in a direction toward the jamb, means for displacing said latch pins in unison generally toward and away from each other between locked and unlocked positions, and releasable means for temporarily retaining said latch pins recessed within said cartridge housing to permit installation of said lock mechanism into the stile member;

said displacing means comprising a tumbler gear rotatably supported within said housing, first and second racks supported in meshed relation with said tumbler gear on opposite sides thereof, track means slidably supporting said racks for movement in opposite directions upon rotation of said tumbler gear, and means coupled respectively between said racks and said latch pins for displacing said latch pins in opposite directions upon rotation of said tumbler gear;

lock operator means accessible from indoor and outdoor sides of the door for rotating said tumbler gear; and a latch keeper on the door jamb including means for releasable locked engagement with said latch pins when the door is closed and said latch pins are moved to the locked position.

17. The lock assembly of claim 16 wherein said lock mechanism includes spring means for urging said latch pins toward a normal position projecting outwardly from the door stile.

18. The lock assembly of claim 16 wherein said lock mechanism further includes a control gear, means for rotatably supporting said control gear generally coaxially with said tumbler gear, means for restricting rotation of said control gear to back and forth rotation within a predetermined rotational increment, and actuator means coupled between said tumbler gear and said control gear and coupled further to said lock operator means for rotating said tumbler gear and control gears back and forth through said rotational increment to displace said latch pins between said locked and unlocked positions.

19. The lock assembly of claim 18 wherein said actuator means comprises an elongated actuator blade extending with relatively loose fit through a slot formed in said tumbler gear and extending with a relatively loose fit through a slot formed in said control gear, said control gear rotation restricting means comprising releasable means for preventing rotation of said tumbler gear beyond said predetermined increment and releasable upon initial rotation of said control gear within said predetermined increment to permit such rotation.

20. The lock assembly of claim 13 wherein said latch members springably retract upon attempted closure of the door with said lock mechanism in said locked position to avoid damage to said lock mechanism and to move the door at least slightly toward the open position.

* * * * *